US005125703A

United States Patent [19]

Clancy et al.

[11] Patent Number: 5,125,703

[45] Date of Patent: Jun. 30, 1992

[54] DOOR HARDWARE ASSEMBLY

[75] Inventors: Joseph S. Clancy, Union Lake; John M. Clancy, Waterford, both of Mich.

[73] Assignee: Sash Controls, Inc., Ferndale, Mich.

[21] Appl. No.: 740,981

[22] Filed: Aug. 6, 1991

[51] Int. Cl.[5] ..... E05B 65/08

[52] U.S. Cl. ..... 292/337; 292/1.5; 292/DIG. 46; 292/DIG. 60

[58] Field of Search ..... 292/1.5, 143, 173, 336.3, 292/337, 357, DIG. 46, DIG. 60

[56] References Cited

U.S. PATENT DOCUMENTS

| | | | |
|---|---|---|---|
| 2,379,326 | 6/1945 | Voight | 292/173 |
| 4,050,272 | 9/1977 | Tanaka | 292/DIG. 46 X |
| 4,405,164 | 9/1983 | Lint et al. | 292/357 X |
| 4,432,576 | 2/1984 | Wartian | 292/244 |
| 4,656,849 | 4/1987 | Rotondi et al. | 292/1.5 X |
| 4,927,199 | 5/1990 | Wu et al. | 292/1.5 |

OTHER PUBLICATIONS

Door Hardware Assembly, Photographs A, B, C, D, E, F, G, H, I, J and K.

*Primary Examiner*—Richard E. Moore
*Attorney, Agent, or Firm*—Krass & Young

[57] ABSTRACT

A door handle assembly including an escutcheon plate, a handle secured to the outer face of the escutcheon plate, and a turn lever mounted on the outer face of the escutcheon plate. The turn lever includes an actuator portion which passes through a transverse slot in the escutcheon plate and through an actuator hole in the door for access to the actuator of a latch assembly so as to move the latch assembly between latched and unlatched positions in response to turning of the turn lever. The actuator portion of the turn lever may be moved laterally within the slot in the escutcheon plate to accommodate door installations in which the actuator hole is centered with respect to the mounting holes for the escutcheon plate as well as installations in which the actuator hole is offset with respect to the mounting holes and the lever portion of the turn lever acts in both installations, and in all positions of the actuator portion of the turn lever, to completely mask the slot so as to preserve a pleasing exterior appearance for the door assembly. The slot also allows the same door assembly to be used for either right handed or left handed installations. The slot is provided offset with respect to the longitudinal midpoint of the escutcheon plate so as to accommodate the vast majority of door installations and a further slot is provided on the midpoint of the escutcheon plate to accommodate those installations where the actuator hole in the door is centered with respect to the mounting holes in the door.

17 Claims, 3 Drawing Sheets

DOOR HARDWARE ASSEMBLY

TECHNICAL FIELD

This invention relates to door hardware assemblies and more particularly to door handle assemblies for use with sliding doors.

Sliding doors are commonly in use in both commercial and residential buildings to provide ready and convenient passage between the interior of the building and, for example, a patio area on the exterior of the building. Whereas many door handle assemblies have been proposed and utilized, the various prior art door handle assemblies are either unattractive in appearance, ineffective in operation, or are dedicated to a particular door installation with a different door handle assembly required for each different door installation.

SUMMARY OF THE INVENTION

This invention relates to a door handle assembly especially suitable for sliding doors which is attractive in appearance and which is usable with a wide range of door installations.

The present invention relates to a door hardware assembly of the type including an elongated escutcheon plate having an inner face adapted to be positioned on a face of the associated door proximate a latching edge of the door and including an aperture, and a turn lever mounted on the outer face of the escutcheon plate. The turn lever includes an actuator portion extending through the escutcheon plate aperture for engagement with the actuator of a latch assembly positioned in the latching edge of the door and a lever portion connected to the actuator portion and movable between a latched position and an unlatched position to respectively move the latch assembly between a latched position and an unlatched position. According to the invention, the aperture in the escutcheon plate comprises a transverse slot having a major dimension substantially exceeding the maximum dimension of the actuator portion of the turn lever. With this arrangement, a single escutcheon plate and turn lever combination may be utilized with a wide variety of door applications irrespective of the positioning of the actuator hole in the door relative to other attachment points of the door handle assembly.

According to a further feature of the invention, the lever portion of the turn lever is dimensioned such that the slot is substantially completely masked by the lever portion irrespective of the position of the lever portion at or between its latched and unlatched positions. This arrangement ensures that the door handle assembly will present an aesthetically pleasing appearance irrespective of the particular door assembly application and irrespective of the position of the turn lever.

According to a further feature of the invention the slot is offset with respect to the longitudinal midpoint of the escutcheon plate and the escutcheon plate further includes means for providing another, on-center slot in the escutcheon plate proximate the longitudinal midpoint. This arrangement allows the invention door handle assembly to be further utilized in association with latch mechanism actuators that are both on-center and off-center with respect to the longitudinal midpoint of the escutcheon plate.

According to a further feature of the invention the means providing either the off-center slot or the on-center slot comprises means defining a knockout area on the escutcheon plate which is readily removable and which, when removed, provides the respective slot.

In the disclosed embodiment of the invention, the assembly further includes a handle including opposite end portions secured to the opposite ends of the escutcheon plate in symmetrical relation to the ends of the escutcheon plate so that the off-center slot in the escutcheon plate is offset with respect to the midpoint between the end portions of the handle and the on-center slot is centered with respect to the end portions of the handle.

DETAILED DESCRIPTION OF THE PREFERRED EMBODIMENT

Figure 1:
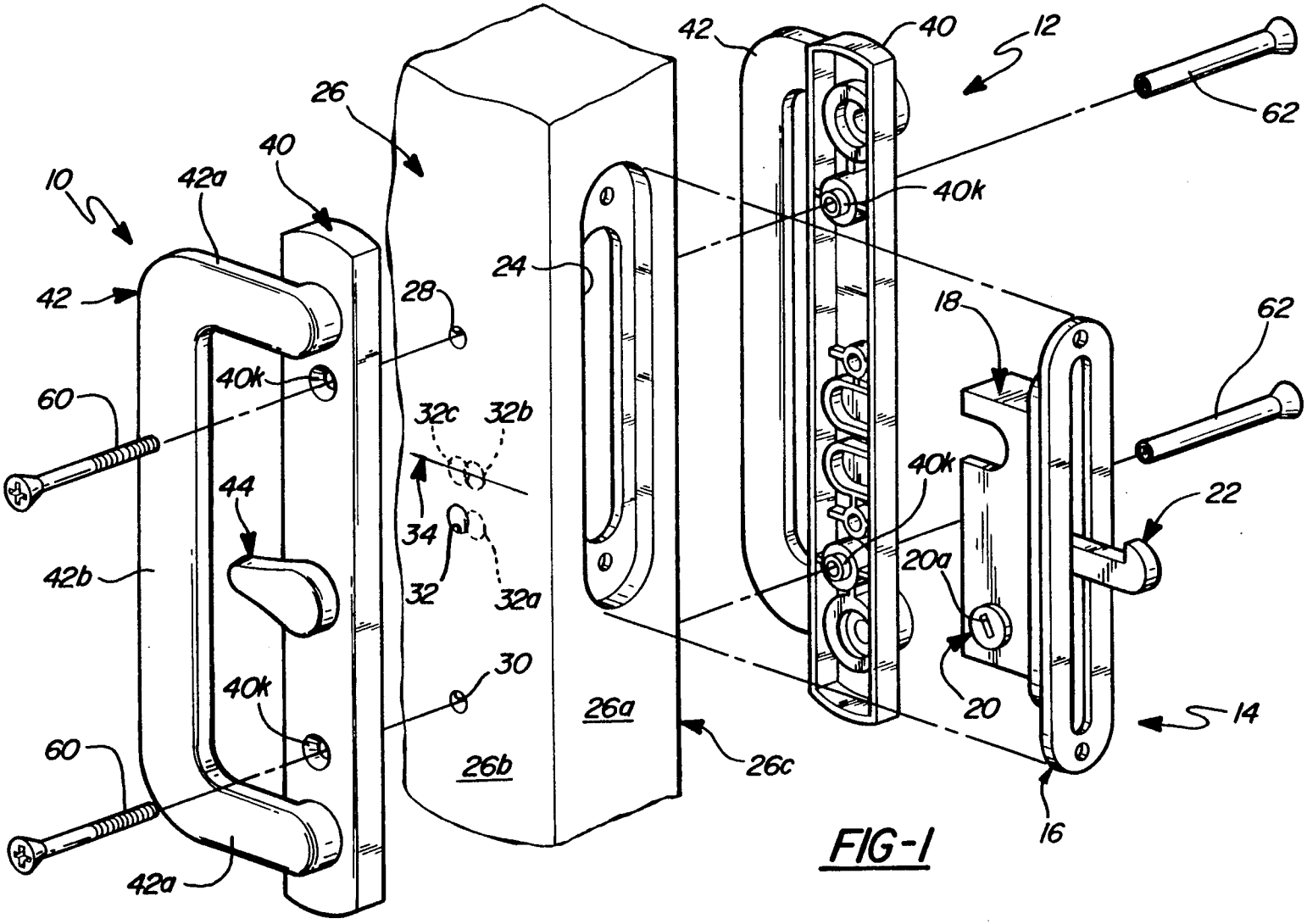
FIG. 1 is an exploded fragmentary view of the invention door handle assembly shown in conjunction with a door latch assembly.
Figure 2:
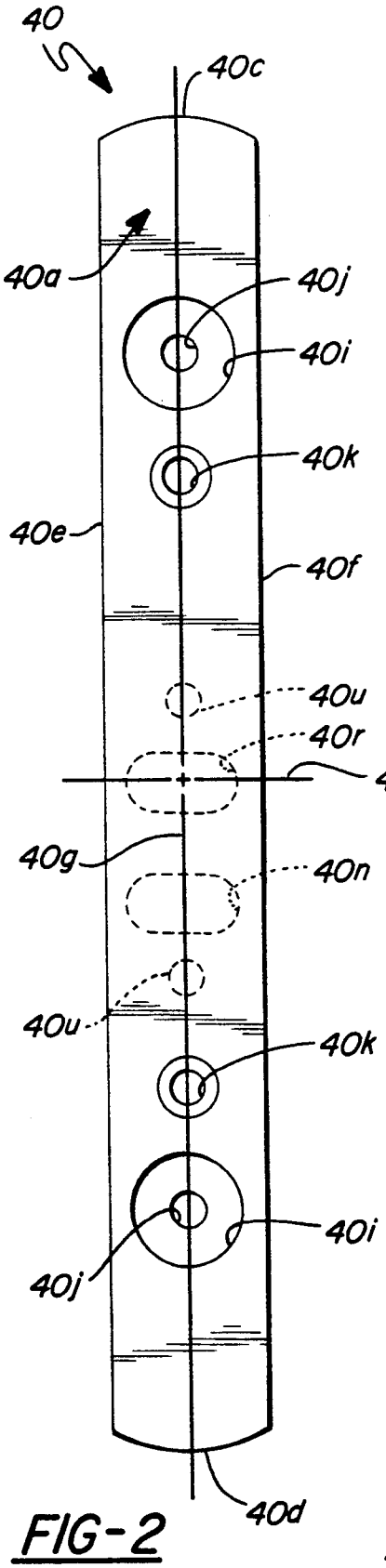
FIGS. 2, 3, and 4 and detailed views of an escutcheon plate utilized in the invention door handle assembly.
Figure 3:
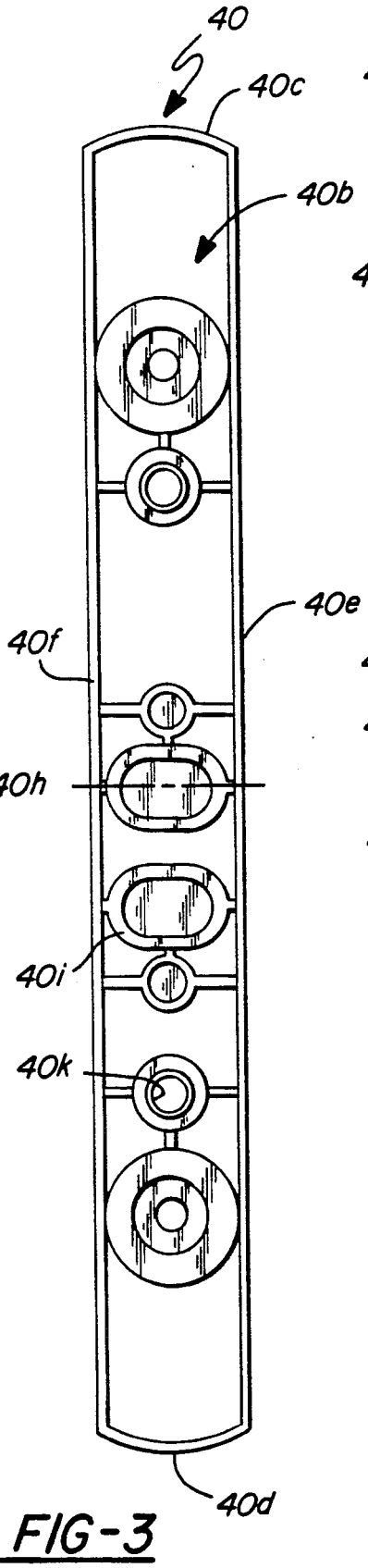
Figure 4:
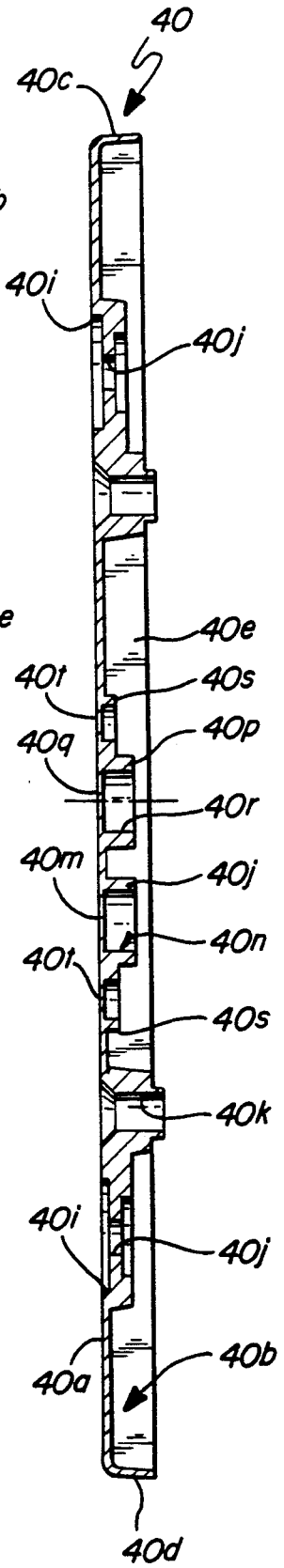

The invention door handle assembly, in its preferred form, comprises an inner door handle assembly 10 which is shown in FIG. 1 in conjunction with an outer door handle assembly 12 and a latch assembly 14.

Latch assembly 14 includes a mounting or trim plate 16 and a latch mechanism 18 including an actuator 20 and a latch member 22 movable in known manner between latched and unlatched positions in response to rotary movement of actuator 20. Latch assembly 14 is received in a cut-out 24 in the latching vertical edge or face **26*a* of a door 26 with the outer face of the trim plate 16 mounted flush with the outer face of the latching edge 26*a* in the installed position of the latch assembly within the cut-out 24**.

Inner door handle assembly 10 is secured to the inner face **26*b* of the door and outer door handle assembly 12 is secured to the outer face 26*c* of the door. An upper mounting hole 28 passes through the door proximate the upper end of cut-out 24, and a lower mounting hole 30 passes through the door proximate the lower end of cut-out 24, and an actuator hole 32 is provided in the door in alignment with actuator 20 of the latch assembly with the latch assembly positioned in cut-out 24**.

Actuator hole 32 may, depending upon the particular door installation, be positioned, as shown in solid lines in FIG. 1, in alignment with the mounting holes 28 and 30 but offset below the horizontal midpoint centerline 34 between the mounting holes; may be forwardly and horizontally offset with respect to the mounting holes 28 and 30 and offset below the centerline 34 (**32*a*); may be forwardly offset with respect to the mounting holes 28 and 30 but on the centerline 34 (32*b*); or may be aligned with mounting holes 28 and 30 and on the centerline 34 (32*c*). It will be understood that doors are provided by the various door manufacturers with the holes 28, 30 and 32** already formed in the door and that the door assembly as provided by the door assembly manufacturers must be able to accommodate the various mounting and actuator hole arrangements in the various door assemblies.

The invention door handle assembly 10 includes an elongated escutcheon plate 40, a door handle 42, and a turn lever 44. All of the elements are preferably formed of solid brass, or zinc with a brass coating.

Escutcheon plate 40 includes an outer face 40*a* and an inner face 40*b* and further defines an upper edge 40*c*, a lower edge 40*d*, a left side edge 40*e*, a right side edge 40*f*, a longitudinal or vertical centerline 40*g*, and a transverse or horizontal centerline 40*h*.

A pair of recesses 40*i* are provided in the outer face 40*a* of the escutcheon plate proximate each end of the escutcheon plate. Recesses 40*i* are centered on centerline 40*g* and are symmetric with respect to centerline 40*h*. A through hole 40*j* is provided concentrically within each recess 40*i*. A pair of mounting holes 40*k* are provided on centerline 40*g* in symmetric relation to centerline 40*h* and respectively inboard of recesses 40*i*. An oblong boss 401 is provided on the under face of the escutcheon plate below centerline 40*g* and centered on centerline 40*g*. Boss 401 defines an oblong knock out area 40*m* therewithin so as to provide a transverse oblong slot 40*n* upon removal of area 40*m*. A further oblong boss 40*p* is provided on the under face of the escutcheon plate on centerline 40*h*. Boss 40*p* defines an oblong knockout area 40*q* therewithin so as to provide, upon removal of the area 40*q*, a further transverse oblong slot 40*r* centered on centerlines 40*g* and 40*h*. Oval bosses 40*s* are also provided on the under face of the escutcheon plate to define further knockout areas 40*t* above and below slots 40*n* and 40*r* to optionally provide holes 40*u*.

Handle 42 includes end portions 42*a* and offset main body portion 42*b*. End portions 42*a* are seated in respective recesses 40*i* whereafter suitable fastener members are passed through holes 40*j* from the underside of the escutcheon plate to secure the handle to the outer face 40*a* of the escutcheon plate with main body portion 42*b* laterally offset with respect to the escutcheon plate to allow access to the outer face 40*a* of the escutcheon plate between the upper and lower end portions of the handle.

Turn lever 44 includes a lever portion 44*a* and an actuator portion 44*b*. Actuator portion 44*b* has a circular configuration and has a diameter slightly less than the minor dimension of slots 40*n* and 40*r* so that actuator portion 44*b* may pass through slot 40*n* or slot 40*r* and may assume any position of transverse adjustment within the slot. Lever portion 44*a* includes a generally circular section 44*c* and a lever section 44*d*. Circular section 44*c* is concentric with respect to actuator portion 44*b* but has a substantially larger diameter than actuator portion 44*b*. Actuator 44 further includes a tail piece 46 suitably crimped between prong portions 44*e* formed integrally with actuator portion 44*b*. Tail piece 46 is sized to fit into a slot 20*a* provided in the latch mechanism actuator 20.

Outer handle assembly 12 includes an escutcheon plate 40 and a handle 42. Handle 42 of the outer handle assembly is secured to the escutcheon plate 40 of the outer handle assembly in a position rotated 180° with respect to the handle of the inner handle assembly.

It will be understood that, in use, the latch assembly 18 is suitably positioned in cut-out 24 and the inner and outer door handle assemblies 10 and 12 are respectively positioned against the inner and outer faces 26*b* and 26*c* of the door proximate latching edge 26*a* by screws 60 passing through mounting holes 40*k* in the escutcheon plate of the inner handle assembly and through mounting holes 28,30 in the door for threaded coaction with tube nuts 62 passing through mounting holes 40*k* in the escutcheon plate of the outer handle assembly and into mounting holes 28,30.

Figure 7:
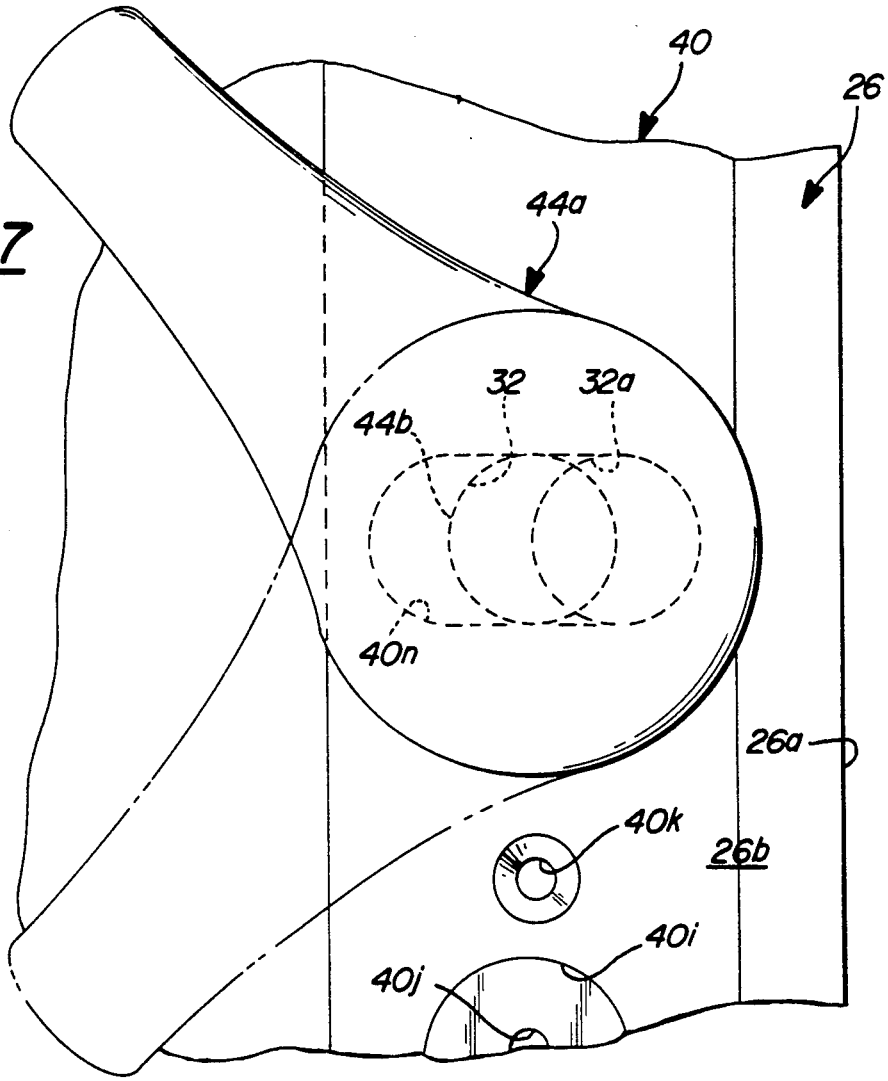
FIG. 7 is a fragmentary view showing the interaction between the escutcheon plate and the turn lever.
Figure 5:
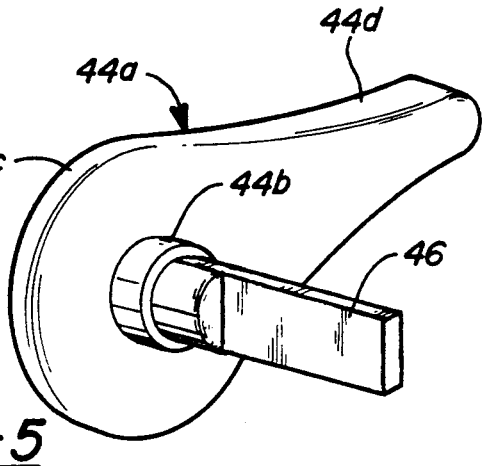
FIG. 5 and 6 are detailed views of a turn lever utilized in the invention door handle assembly.
Figure 6:
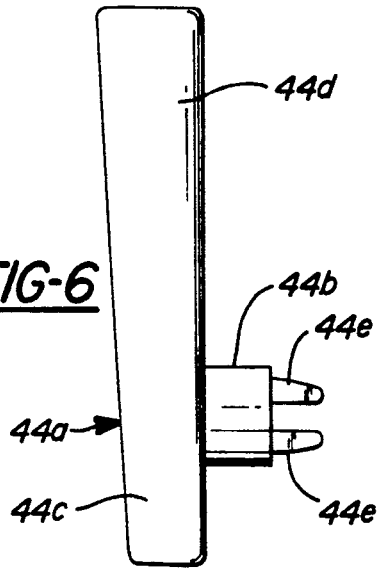

The invention door handle assembly, and specifically the slots 40*n* and 40*r* in coaction with the actuator portion 44*b* of the turn lever 44, allows the inner door handle assembly 10 to be utilized in association with a variety of door latching arrangements. Specifically, if the door latching arrangement requires an actuator hole in alignment with mounting holes 28 and 30 but downwardly offset with respect to the midpoint of the mounting holes, the material 40*m* within boss 401 is removed (either by the door handle assembly manufacturer or at the door installatin site) and the actuator portion 40*b* is centered within the slot 40*n* for passage through the actuator hole 32. In this position of the actuator portion 40*b* centrally within slot 40*n* the lever portion 44*a* of the turn lever will completely mask the slot 40*n* in either the latched position of the turn lever, seen in solid lines in FIG. 7, or in the unlatched position of the turn lever, seen in dotted lines in FIG. 7 which positions may, for example, be spaced by 90° with the latched position angled upwardly 45° with respect to the horizontal and the unlatched position angled downwardly 45° with respect to the horizontal.

Alternatively, if the door installation includes an actuator hole 32*a* which is downwardly offset and also forwardly offset with respect to the mounting holes 28,30 toward the door edge 26*a*, the actuator portion 44*b* of the turn lever passes through the forward portion of the slot 40*n* and the lever portion 44*a* of the turn lever again acts to completely mask the slot 401 in either the latched or the unlatched position of the turn lever or in any position therebetween.

It will be understood that the description thus far has related to a so called right hand installation in which the door latch is provided on the right hand edge of the door. In a left hand installation in which the door latch is provided on the left hand edge of the door, the same inner door handle assembly 10 may be employed with the exception that the handle 42 is now rotated 180° so that it extends rearwardly away from the latching edge and the actuator portion 44*b* of the turn lever, for a situation in which the actuator hole is downwardly offset as well as forwardly offset with respect to the mounting holes, is positioned in the other end of the slot 40*n* (as compared to the end of the slot in which the actuator portion would be positioned in a comparable right hand door installation) with the lever portion 44*a* of the turn lever again acting in both the latched and unlatched positions of the turn lever to completely mask the slot 401.

For door installations in which the actuator hole 32*b* is positioned midway between the mounting holes 28, 30, either on the centerline of mounting holes 28 and 30 or offset with respect to these holes, the material 40*q* of the escutcheon plate within boss 40*p* is suitably knocked out (either at the factory or at the construction site) to provide a slot 40*r* which may receive the actuator portion 44*b* of the turn lever with the lever portion 44*a* again acting, in either installation, to completely mask the slot 40*p* in either the latched or unlatched position of the turn lever. Further, for left hand door installations in which the actuator hole is positioned midway between the mounting holes 28 and 30 but forwardly offset with respect to these holes, the actuator portion of the turn lever will be positioned in the end of the slot 40*r* nearest the latching door edge (opposite to the end in which it is positioned for a comparable right hand installation) and the lever portion of the turn lever will again mask the slot 40*r* in all positions of the turn lever.

It will be understood that the outside handle assembly 12 would most typically not include a keylock assembly to allow access to the interior of the building by the use of a key. However, in those installations where an exterior key lock is desired, the key lock may be mounted to the outer face of the escutcheon plate 40 of the outer door assembly by knocking out the areas 40*t* defined by the bosses 40*s* so as to thereby allow the key lock mechanism to be secured to the outer face of the escutcheon plate and allow the tail piece of the key lock to pass either through slot 40*r* or slot 40*n* (depending on the on-center or off-center location of the latch actuator 20) for access to the actuator 20 of the latch mechanism to enable the door to be unlocked with a key from the outside of the door.

The invention will be seen to provide a door handle assembly that is aesthetically pleasing and that is adaptable to accommodate a wide variety of door installations. Specifically, a slot in the escutcheon plate in combination with the actuator portion of the turn lever fitting within the slot allows the invention door handle assembly to be used with a variety of actuator hole placements in the door while ensuring a pleasing appearance of the assembly irrespective of the particular installation. Further, the provision of a first slot offset with respect to the longitudinal midpoint of the escutcheon plate in combination with a second slot on the midpoint of the escutcheon plate, with the slot in each case coacting with the actuator portion of the turn lever to accommodate varying, actuator hole locations, provides further versatility for the door handle assembly while maintaining a pleasing appearance in all installations. Further, the slot and turn handle arrangement allows the same escutcheon plate and turn lever to be used in either right handed or left handed door installations while providing a pleasing exterior appearance in both cases.

Whereas a preferred embodiment of the invention has been illustrated and described in detail it will be apparent that various changes may be made in the disclosed embodiment without departing from the spirit or scope of the invention.

We claim:

1. A door hardware assembly including an elongated escutcheon plate having an inner face adapted to be positioned on a face of the associated door proximate a latching edge of the door and including an aperture, and a turn lever mounted on the outer face of the escutcheon plate and including an actuator portion extending through the escutcheon plate aperture for engagement with an aperture of a latch assembly positioned in the latching edge of the door and a lever portion connected to the actuator portion and movable between a latched position and a unlatched position to respectively move the latch assembly between a latched position and an unlatched position; characterized in that the aperture in the escutcheon plate comprises a transverse slot having a major dimension substantially exceeding the maximum dimension of said actuator portion of said turn lever so that the actuator portion may pass through the slot at different transverse locations relative to the slot to access latch actuators having varying setbacks with respect to the door edge.

2. A door hardware assembly according to claim 1 wherein said lever portion of the turn lever is dimensioned such that the slot is substantially completely masked by the lever portion irrespective of the position of the lever portion at or between its latched and unlatched positions and irrespective of the transverse position of the actuator portion in the slot.

3. A door hardware assembly according to claim 2 wherein said slot is offset with respect to the longitudinal midpoint of the escutcheon plate.

4. A door hardware assembly according to claim 3 wherein said escutcheon plate further includes another transverse slot in said escutcheon plate at said midpoint.

5. A door hardware assembly according to claim 4 wherein either or both of said slots is provided by means defining a knockout area on said escutcheon plate which is readily removable and which, when removed, provides the respective slot.

6. A door hardware assembly according to claim 1 wherein said assembly further includes a handle mounted on said escutcheon plate.

7. A door hardware assembly according to claim 6 wherein said handle includes opposite end portions secured to opposite ends of the escutcheon plate with said slot bracketed therebetween.

8. A door hardware assembly according to claim 7 wherein said slot is offset with respect to the midpoint between said handle end portions.

9. A door hardware assembly according to claim 8 wherein said handle end portions are symmetrical with respect to the longitudinal midpoint of the escutcheon plate so that said slot is offset with respect to the longitudinal midpoint of the escutcheon plate.

10. A door hardware assembly including an elongated escutcheon plate adapted to be secured at its inner face to a side face of a door proximate a vertical latching edge of the door and including an aperture, and a turn lever mounted on the outer face of the escutcheon plate and including an actuator portion extending through the escutcheon plate aperture for engagement with the actuator of a latch assembly positioned in the latching edge of the door and a lever portion connected to the actuator portion and movable between a latched position and an unlatched position to respectively move the latch assembly between a latched position and an unlatched position; characterized in that the aperture in the escutcheon plate has a maximum dimension substantially exceeding the maximum dimension of the actuator portion of the turn lever and the lever portion of the turn lever is dimensioned such that the aperture is substantially completely masked by the lever portion irrespective of the position of the turn lever at or between its latched and unlatched positions.

11. A door hardware assembly according to claim 10 wherein said aperture comprises a slot extending transversely of the escutcheon plate and offset with respect to the longitudinal midpoint of the escutcheon plate.

12. A door hardware assembly according to claim 11 wherein the escutcheon plate further includes means for providing another transverse slot in the escutcheon plate at the longitudinal midpoint of the escutcheon plate.

13. A door hardware assembly according to claim 12 wherein either or both of said slots is provided by means defining as knockout area on the escutcheon plate which is readily removable and which, when removed, provides the respective slot.

14. A door hardware assembly according to claim 10 wherein said assembly further includes a handle mounted on the escutcheon plate.

15. A door hardware assembly according to claim 14 wherein said handle includes opposite end portions secured to opposite ends of the escutcheon plate with said aperture bracketed therebetween.

16. A door hardware assembly according to claim 7 wherein said aperture comprises a slot extending transversely of said escutcheon plate and offset with respect to the midpoint between the handle end portions.

17. A door hardware assembly according to claim 16 wherein the handle end portions are symmetrical with respect to the longitudinal midpoint of the escutcheon plate so that said slot is offset with respect to the longitudinal midpoint of the escutcheon plate.

* * * * *